US005190382A

United States Patent [19]

Koshiishi et al.

[11] Patent Number: 5,190,382

[45] Date of Patent: Mar. 2, 1993

[54] PRINT ELEMENT ARRANGEMENT IN SERIAL MATRIX PRINTER

[75] Inventors: Osamu Koshiishi; Takashi Asada; Kiyofumi Koike; Masaki Shimomura, all of Suwa, Japan

[73] Assignee: Seiko Epson Corporation, Japan

[21] Appl. No.: 602,527

[22] Filed: Oct. 24, 1990

[30] Foreign Application Priority Data

Oct. 26, 1989 [JP] Japan ..... 1-280464

[51] Int. Cl.[5] ..... B41J 2/255

[52] U.S. Cl. ..... 400/121; 400/124

[58] Field of Search ..... 400/120, 121, 124; 364/518, 519, 523; 395/108

[56] References Cited

U.S. PATENT DOCUMENTS

| | | | |
|---|---|---|---|
| 4,279,521 | 7/1981 | Kightlinger | 400/124 |
| 4,400,101 | 8/1983 | Hendrischk | 400/124 |
| 4,431,319 | 2/1984 | Karaki et al. | 400/124 |

FOREIGN PATENT DOCUMENTS

| | | | |
|---|---|---|---|
| 3208104 | 9/1983 | Fed. Rep. of Germany | 400/124 |
| 63-252757 | 10/1988 | Japan | 400/120 |
| 1-40345 | 2/1989 | Japan | 400/124 |
| 1-113256 | 5/1989 | Japan | 400/124 |
| 2198391 | 6/1988 | United Kingdom | 400/124 |

*Primary Examiner*—David A. Wiecking

[57] ABSTRACT

A serial printer having a dot type printing head for printing on a paper. The printer includes 2N columns of dot forming elements where N is a positive integer equal to 2 or more and a carriage supported on the printer for reciprocal movement across the paper in a carriage direction. The columns of dot forming elements are supported on the carriage for selectively printing dots on a paper. Each column of the dot forming elements is spaced a predetermined distance from adjacent columns of the dot forming elements in the carriage direction. Each dot forming element column includes a plurality of dot forming elements arranged in a line and spaced apart from one another in the column direction by a dot pitch substantially equal to N. A drive system selectively drives selected dot forming elements in each column of dot forming elements by one of an even number timing and an odd number timing. Each column of dot forming elements driven by an even number timing is shifted in the column direction by one dot with respect to each other column of dot forming elements driven by an even number timing. Each column of dot forming elements driven by an odd number timing is shifted in a column direction by one dot with respect to each other column of dot forming elements driven by an odd number timing. Each column of dot forming elements driven by an even number timing is shifted in the column direction by less than about ⅓ dot pitch with respect to at least one column of dot forming elements driven by an even number timing.

9 Claims, 7 Drawing Sheets

PRINT ELEMENT ARRANGEMENT IN SERIAL MATRIX PRINTER

BACKGROUND OF THE INVENTION

The present invention relates generally to a serial printer, and, in particular, to a printer provided with a dot type printing head having a plurality of dot forming elements arranged as an assembly of dots to print characters and figures.

In a conventional serial printer, the dot type printing head is constructed with a large number of dot forming elements to achieve a high quality character printing and high printing speed. There are two types of arrangements of dot forming elements in a single printing head as set forth in the prior art. Referring specifically to FIG. 1(*a*), a first arrangement including a printing head having forty eight (48) dot forming elements is shown. When the printing head is mounted on a carriage, a four row dot forming element chain is formed by vertically arranging twelve (12) dot forming elements in four rows. Additionally, the twelve (12) dot forming elements are spaced at two dot intervals and are arranged to be vertically shifted by two dots between neighboring dot forming element chains.

Referring specifically to FIG. 2(*a*), a second arrangement is shown having four units. The four units are constructed by vertically arranging twelve (12) dot forming elements in four rows at two dot intervals. The neighboring first and second units and the third and fourth units are arranged to vertically align the dot forming positions. The dot forming positions are selected to vertically shift bit by bit between both the first and second units and the third and fourth units respectively.

In the first arrangement of the prior art, the dot forming positions of each unit are vertically shifted by ½ dot. Therefore, the dots are vertically arranged and interposed achieving an overlap of ½ dot as shown in FIG. 1(*b*). Accordingly, a fine dot pattern is produced with a high printing quality.

Further, the first arrangement of the prior art provides a printer having a draft printing mode with high printing speed, but inferior printing quality in addition to a normal printing mode with high printing quality. However, the disadvantages occur when a horizontal line is printed. When a horizontal line is printed by two units either the first and second units or the third and fourth units, the neighboring dots are vertically and alternately shifted by ½ dots so that character quality is degraded as shown in FIG. 1(*c*).

In the second arrangement of the prior art, two units are provided for printing the position of a character or figure. Therefore, since the assembly of dots are arranged in a straight line, high printing speed can be performed while at the same time a horizontal line can be printed with a high printing quality. However, since the dot forming elements are arranged at one dot intervals, a mutual interposition of dots can not be vertically performed as shown in FIG. 2(*b*). Therefore, the print quality is degraded in the normal printing mode as shown in FIG. 2(*c*).

Hence, the prior art discloses serial print heads which degrade the print quality in either the normal printing mode or the draft printing mode.

Accordingly, it is desired to provide an improved dot head for a serial printer which at a high printing speed can produce a high printing quality in both the normal printing mode and the draft printing mode.

SUMMARY OF THE INVENTION

Generally speaking, in accordance with the present invention, a serial printer having a dot type printing head for printing on a paper, is provided. The printer includes 2N columns of dot forming elements where N is a positive integer equal to 2 or more, and a carriage supported on the printer for reciprocal movement across the paper in a carriage direction. The columns of dot forming elements are supported on the carriage for selectively printing dots on the paper. Each column of the dot forming elements is spaced a predetermined distance from adjacent columns of the dot forming elements in the carriage direction. Each dot forming element column includes a plurality of dot forming elements arranged in a line and spaced apart from one another in the column direction by a dot pitch substantially equal to N. A drive system selectively drives selected dot forming elements in each column of dot forming elements by one of an even number timing and an odd number timing. Each column of dot forming elements driven by an even number timing is shifted in the column direction by one dot with respect to each other column of dot forming elements driven by an even number timing. Each column of dot forming elements driven by an odd number timing is shifted in a column direction by one dot with respect to each other column of dot forming elements driven by an odd number timing. Each column of dot forming elements driven by an even number timing is shifted in the column direction by less than about ⅓ dot pitch with respect to at least one column of dot forming elements driven by an even number timing.

In a preferred embodiment, each column of dot forming elements driven by an even number timing is shifted in a column direction by between about 1/9 and ⅓ dot pitch with respect to at least one column of dot forming elements driven by an odd number timing. Also, in a preferred embodiment, N=2 thereby providing four columns of dot forming elements. Each column preferably includes twelve dot forming elements. One of the preferred spacings in the column direction between columns of dot forming elements driven by even numbered timings and odd numbered timings is a ¼ dot pitch.

Accordingly, it is an object of the invention to provide an improved serial printer using a dot type printing head.

Another object of the invention is to provide a printing head which can produce high printing quality in both the normal printing mode and in a draft printing mode.

A further object of the invention is to provide a printer having a novel printing head which can print at a high printing speed while at the same time producing high printing quality.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1(*b*) is a diagram showing the position of the enlarged dots of the letter "A" printed in a normal printing mode of the prior art;

FIG. 1(*c*) is a diagram showing the position of the enlarged dots of the letter "A" printed in a draft printing mode of the prior art;

FIG. 2(*b*) is a diagram showing an enlarged dot position of the letter "A" printed in a normal printing mode of the prior art;

FIG. 2(*c*) is a diagram showing an enlarged dot position of the letter "A" printed in a draft mode of the prior art;

FIG. 6(*b*) is a diagram showing the position of the large dots of the letter "A" printed by the device in a normal printing FIG. 6(*c*) is a diagram showing the positions of the enlarged dots of the letter "A" printed in a draft printing mode;

DETAILED DESCRIPTION OF THE PREFERRED EMBODIMENTS

Figure 3:
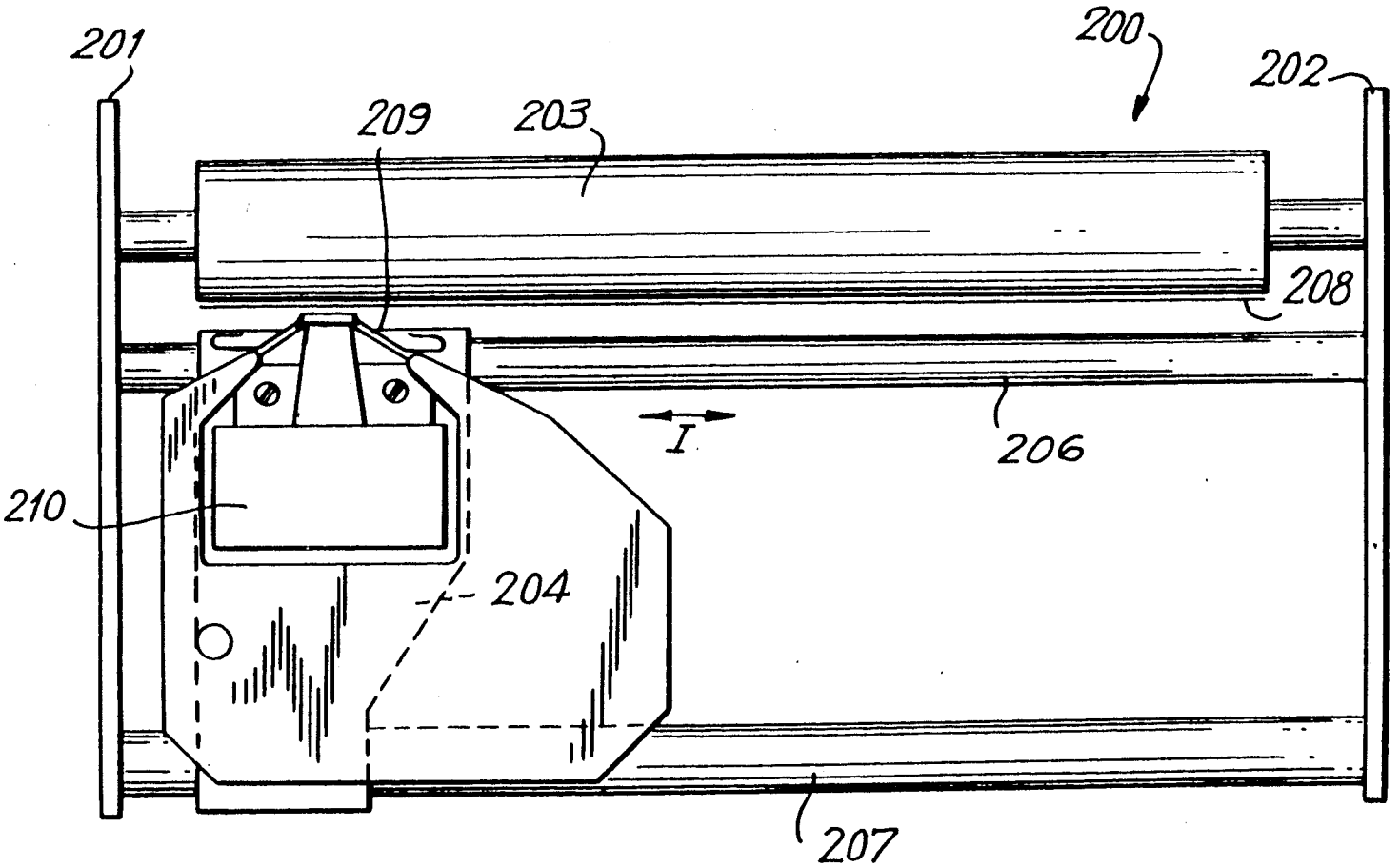
FIG. 3 is a top plan view of a serial printer with a dot type printing head in accordance with the invention.

Reference is first made to FIG. 3 of the drawings which depicts a serial printer, generally indicated at 200, having an impact dot head 210 constructed in accordance with the present invention. Impact dot head 210 is supported on a carriage 204 which is slidingly supported on rods 206 and 207 adjacent to a platen 203. Carriage 204 performs a reciprocal movement in the direction of arrow I along platen 203 and rods 206 and 207. A printing medium 208 is arranged between platen 203 and an ink ribbon 209. The arrangement prints figures, letters and the like on printing medium 208 by the interaction of impact dot head 210, carriage 204, platen 203 and ink ribbon 209.

Figure 4:
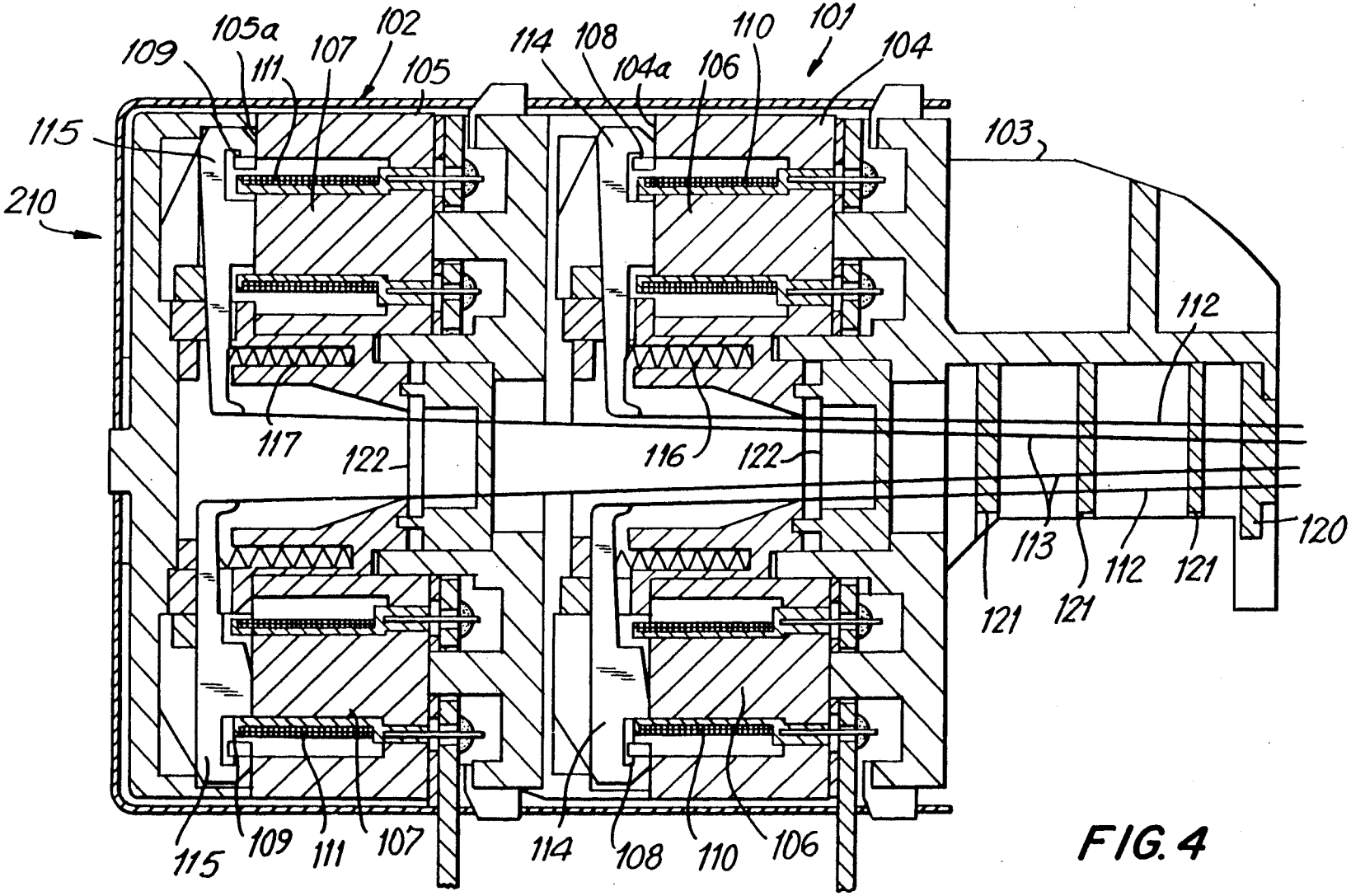
FIG. 4 is a cross-sectional view of a wire dot type printing head in accordance with the invention.

Referring specifically to FIG. 4, printing head 210 is provided in accordance with the invention having printing units 101 and 102. Printing units 101 and 102 are laminated in two stages and are integrally fixed to a nose member 103 to form a dot type printing head for a serial printer.

In printing units 101 and 102, twenty four (24) dot forming elements are constructed in each unit from coils 110 and 111 wound about coils 108 and 109, respectively. The combinations are then inserted into their respective twenty four (24) core portions 106,106, ...106, 107,107 ...107 equally and circularly forming cup-shaped cases 104 and 105, respectively. Cup-shaped cases 104 and 105 act as a magnetic case for printing units 101 and 102. Levers 114 and 115 are pivotably mounted to one end of wires 112 and 113 and are attachably mounted to coils 110 and 111. Wires 112 and 113 are fixed to levers 114 and 115 at one end and outwardly and freely extend from nose member 103 at their other end to form the dot forming elements. In this configuration, nose member 103 guides wires 112 and 113. Coil springs 116 and 117 respectively bias levers 114 and 115 between rest and printing positions.

Accordingly, printing units 101 and 102 drive the ends of wires 112 and 113 in a desired arrangement. End guide plate 120 formed of a wear resistant material such as ceramic or metal is arranged at the end of nose member 103. In addition, a single or plural intermediate guide plates 121 and 122 are arranged between end guide plate 120 and printing head units 101 and 102. Intermediate guide plates 121 and 122 are formed with guide openings to smoothly guide wires 112 and 113 from the ends of levers 114 and 115 through the openings of end guide plate 120.

Figure 5:
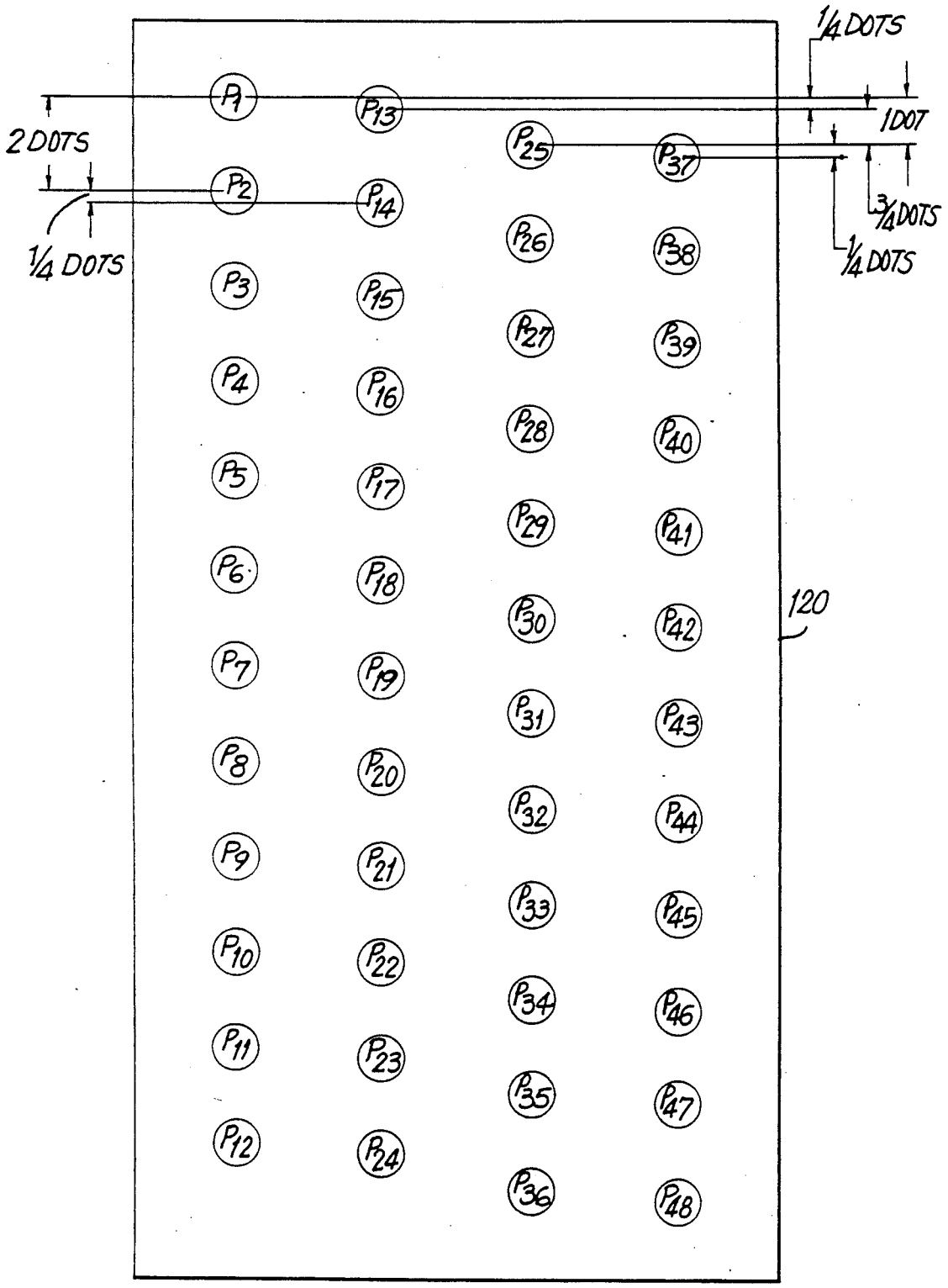
FIG. 5 is a diagram showing the position of the dot forming element chains of the device shown in FIG. 4.

In FIG. 5, the position of the dots is shown when the printing head operates the wires without movement of the carriage. End guide plate 120 has a plurality of vertically arranged guide openings in the Y direction. In the preferred embodiment, end plate 120 has twelve guide openings in the vertical direction. Further, end plate 120 includes four columns defined as the first, second, third an fourth guide opening chains respectively. The wires are inserted into the guide openings to form a first dot chain P1 to P12, a second dot chain P13 to P24, a third dot chain P25 to P36 and a fourth dot chain P37 to P48. In these chains, the dot interval of each chain is determined by wires 112 and 113 at approximately a two dot separation.

When printing head 210 of FIG. 3 is mounted on carriage 204, the dot interval is horizontally and equally spaced at prescribed dot intervals. For example, a four dot interval spacing may be set as the fixed distance. Accordingly, second dot chain P13 to P24 is arranged to be shifted in the range of greater than 1/9 dot but less than $\frac{1}{3}$ dot (i.e. 1/9 dot $< X < \frac{1}{3}$ dot) with respect to first dot chain P1 to P12. In the preferred embodiment, $\frac{1}{4}$ dot is used. Third dot chain P25 to P36 is arranged to be shifted by one dot with respect to first dot chain Pl to P12 or by $\frac{3}{4}$ dots with respect to second dot chain P13 to P24. Fourth dot chain P37 to P48 is arranged to be shifted in the range of greater than 1/9 dot but less than $\frac{1}{3}$ dot with respect to third dot chain P25 to P36. In the preferred embodiment, the arrangement is configured to be shifted by $\frac{1}{4}$ dot. In other words, the arrangement is shifted by 5/4 dots with respect to first dot chain P1 to P12.

Figure 6C:
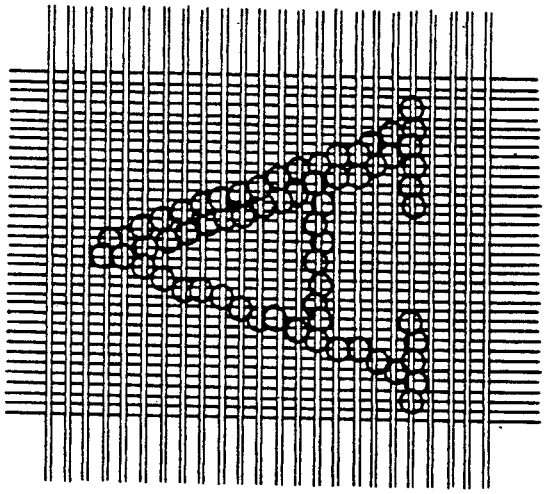
FIG. 6(*a*) is a diagram showing an arrangement of the dot forming element chains of the present invention.
Figure 6B:
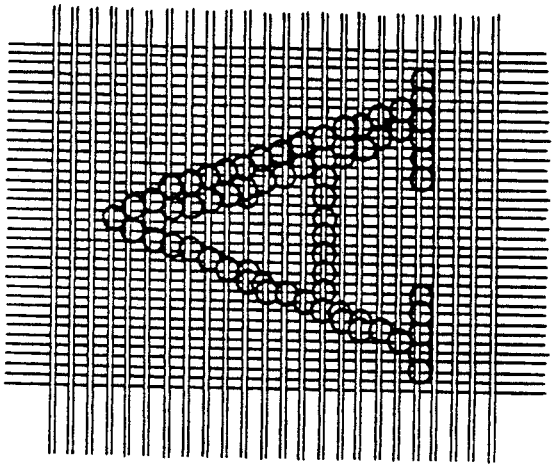
Figure 6A:
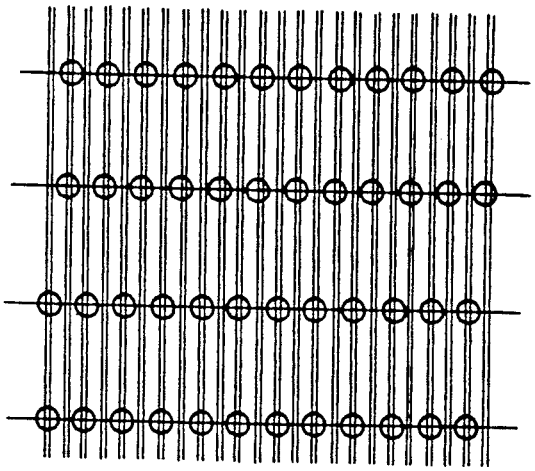

In the present embodiment, the letter "A" is printed using the dot pattern data in a normal printing mode. The arrangement of wires is shown in FIG. 6(*a*) prior to shifting for producing the letter "A". The dot data (1+2n)th from the horizontal base line are printed by the wires corresponding to first dot chain Pl to P12 and is driven by an odd numbered timing. The dot data (2+2n)th are printed by the wires corresponding to second dot chain P13 to P24 and is driven by an even numbered timing. The dot data (3+2n)th are printed by the wires corresponding to the third dot chain P25 to P36 and is driven by an odd numbered timing. The dot data (4+2n)th are printed by the wires corresponding to the fourth dot chain P37 to P48 and is driven by an even numbered timing. Printing head 210 of FIG. 3 travels horizontally with the movement of carriage 204. Therefore, wires move horizontally to correspond to dot chains P1 to P12, P13 to P24, P25 to P36 and P37 to P48 to form dots on printing medium 208 corresponding to the applied dot data.

As previously set forth, first dot chain P1 to P12 and second dot chain P13 to P24 are shifted by ¼ dot with respect to one another and third dot chain P25 to P36 and fourth dot chain P37 to P48 are shifted by ¼ dot with respect to one another. Accordingly, the dots formed on printing medium 208 by wires corresponding to first dot chain P1 to P12 and third dot chain P25 to P36 overlap by an amount ¼ dot and ¾ dot with the dot formed by wires corresponding to second dot chain P13 to P24 and fourth dot chain P37 to P48, respectively. A blank or empty space produced between dots formed by wires corresponding to first dot chain P1 to P12 and third dot chain P25 to P36 driven by the odd numbered timings are filled with dots formed by wires corresponding to second dot chain P13 to P24 and fourth dot chain P37 to P48 driven by an even numbered timing to form smooth line patterns as shown in FIG. 6(*b*).

The vertically neighboring dots are formed by first dot chain P1 to P12 and third dot chain P25 to P36. However, the vertically neighboring dots do not interpose the middle portion between the dots shifted by ½ dot as that in the prior art. To overcome the problems of the prior art, the invention blurs and spreads the ink from the dot printing process. In this manner, the dots are sufficiently interposed over the middle portion so that the printing quality can be performed at the same degree as that of ½ dot shifting.

In a draft printing mode, a printing operation is performed according to dot pattern data for a normal printing mode, but without any interposition of dot data. The printing head in the draft mode can print twice the traveling speed of the normal printing mode. Therefore, the draft printing mode is inferior in character quality in comparison to the normal printing mode, but can print at double the printing speed.

Further, in a draft printing mode, a horizontal line can be printed using the wires corresponding to either first dot chain P1 to P12 and second dot chain P13 to P24 or wires corresponding to third dot chain P25 to P36 and fourth dot chain P37 to P48. In the present embodiment, the horizontally neighboring dots are only shifted by ¼ dot in a zigzag pattern, but the viewer recognizes it as a straight line due to the blur and spread of ink as shown in FIG. 6(*c*).

Figure 1C:
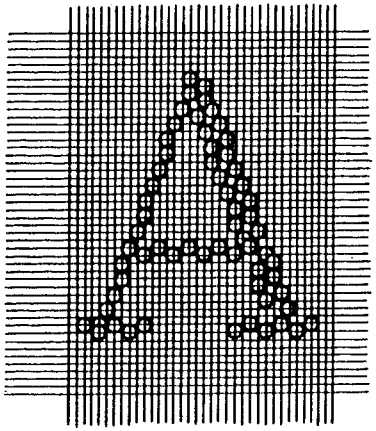
FIG. 1(c) PRIOR ART
FIG. 1(*a*) is a diagram showing the arrangement of the dot forming element chains of the prior art.
Figure 1B:
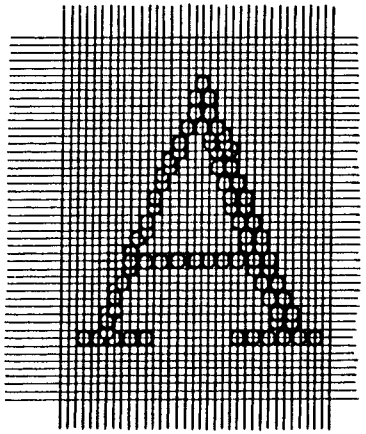
FIG. 1(b) PRIOR ART
Figure 1A:
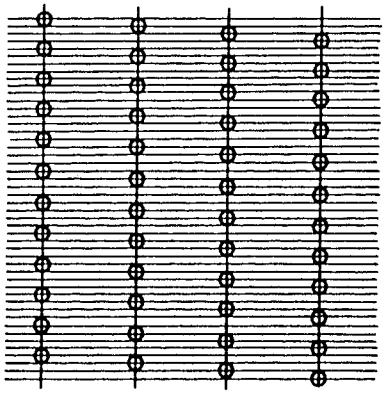
FIG. 1(a) PRIOR ART
Figure 2C:
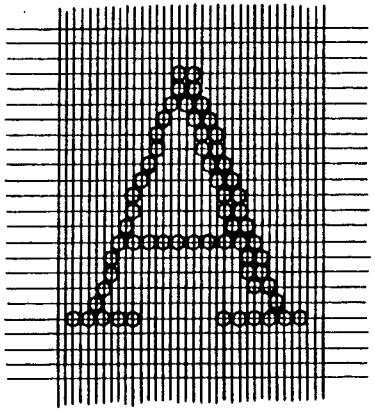
FIG. 2(c) PRIOR ART
FIG. 2(*a*) is a diagram showing the arrangement of dot forming element chains of another embodiment of the prior art having forty eight (48) dot type printing head used with a serial printer.
Figure 2B:
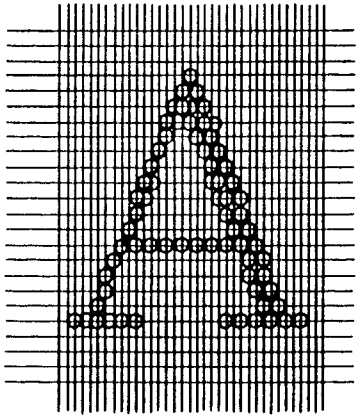
FIG. 2(b) PRIOR ART
Figure 2A:
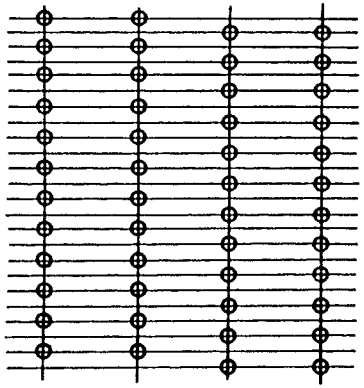
FIG. 2(a) PRIOR ART

Accordingly, the print of the draft mode of the present embodiment is a lower quality compared to the horizontal line printed by a conventional print head of the second arrangement as set forth above and shown in FIG. 2(*c*). However, the present embodiment can provide an extremely high printing quality compared to the conventional print head of the first arrangement as set forth above and shown in FIG. 1(*c*). In FIG. 1(*c*), the dots are mutually and vertically shifted by ½ dot.

As described above, a printing head according to the present invention can provide the printing quality obtained by a printing head with a first conventional arrangement in the vertical direction and obtained by a printing head with a second conventional arrangement in the horizontal direction. For example, to print a table for data, the table can be created with a high printing quality and at high printing speed by switching between a normal printing mode for the data and a draft printing mode for the horizontally ruled lines to form the table.

In another example of the present embodiment, a 0.2 mm diameter wire is used as a dot forming element. A dot forming element chain is constructed by arranging 12 wires each of 0.2 mm diameter and by vertically spacing them at 0.28 mm intervals to produce four rows of dot forming element chains.

The vertical shift between first and second dot forming element chains is set at 0.035 mm. Third dot forming element chain is vertically shifted by 0.14 mm with respect to first dot forming element chain. Fourth dot forming element chain is shifted by 0.035 mm with respect to third dot forming element.

The printing head forms a dot on a printing paper using an ink ribbon. Due to the ink blur, the range of the diameter of ink is from 0.23 to 0.27 mm. This range allows the first dot and the third dot forming element chains to be continuously formed. In this arrangement, the dots formed by second dot forming element chain overlap with the dots obtained by the first dot forming element chain to 0.21 mm. The dot formed by second dot forming element chain overlaps with the dots produced by the third dot forming element chain by 0.14 mm. Also, the dots obtained by fourth dot forming element chain overlap with dots obtained by first dot forming element chain by 0.14 mm. The dot produced by fourth dot forming element chain overlaps with third dot forming element chain by 0.21 mm.

As a result, the dots formed by first and third dot forming element chains are interposed with the dots formed by second and fourth dot forming element chains to produce high quality printing characters. In a draft printing mode, a horizontal line is printed using either first and second dot forming element chains or third and fourth dot forming element chains having a shift between the horizontal dots of 0.14. The shift of 0.14 is derived from the ratio of the vertical shift between the first and second or third and fourth dot forming element chains of 0.035 over the average range of the diameter of the ink dot formed from blurring of 0.25. The small shift in the horizontal lines are printed so that a draft character and ruled lines can be printed with a high quality.

The present invention recites dot forming element chains having even numbered chains and dot forming element chains having odd numbered chains shifted by ¼ dot. However, characters and patterns can be printed having high quality by properly selecting a shift range greater than 1/9 dot and less than ⅓ dot. The range is dependent upon the dot shape or size formed by the dot forming elements.

A wire dot type printing head has been detailed above in accordance with the present invention. However, the same results can be effectively obtained by and applied to a thermal transfer type printing head, a thermal sensitive type printing head, a bubble ink jet type printing head and an ink jet type printing head. The thermal transfer type printing head and the thermal sensitive type printing head are formed from heating elements arranged in rows. Dots are formed by evaporating ink onto a substrate surface. The bubble ink jet type printing head has nozzle openings arranged in rows and heating elements set adjacent to the openings of the jet. An ink droplet contacts the printing medium by utilizing an expansion force of a partially vaporized ink. The ink jet type printing head has a piezoelectric element mounted to an ink reservoir connected to nozzle openings which outputs the ink onto a printing medium.

Figure 7:
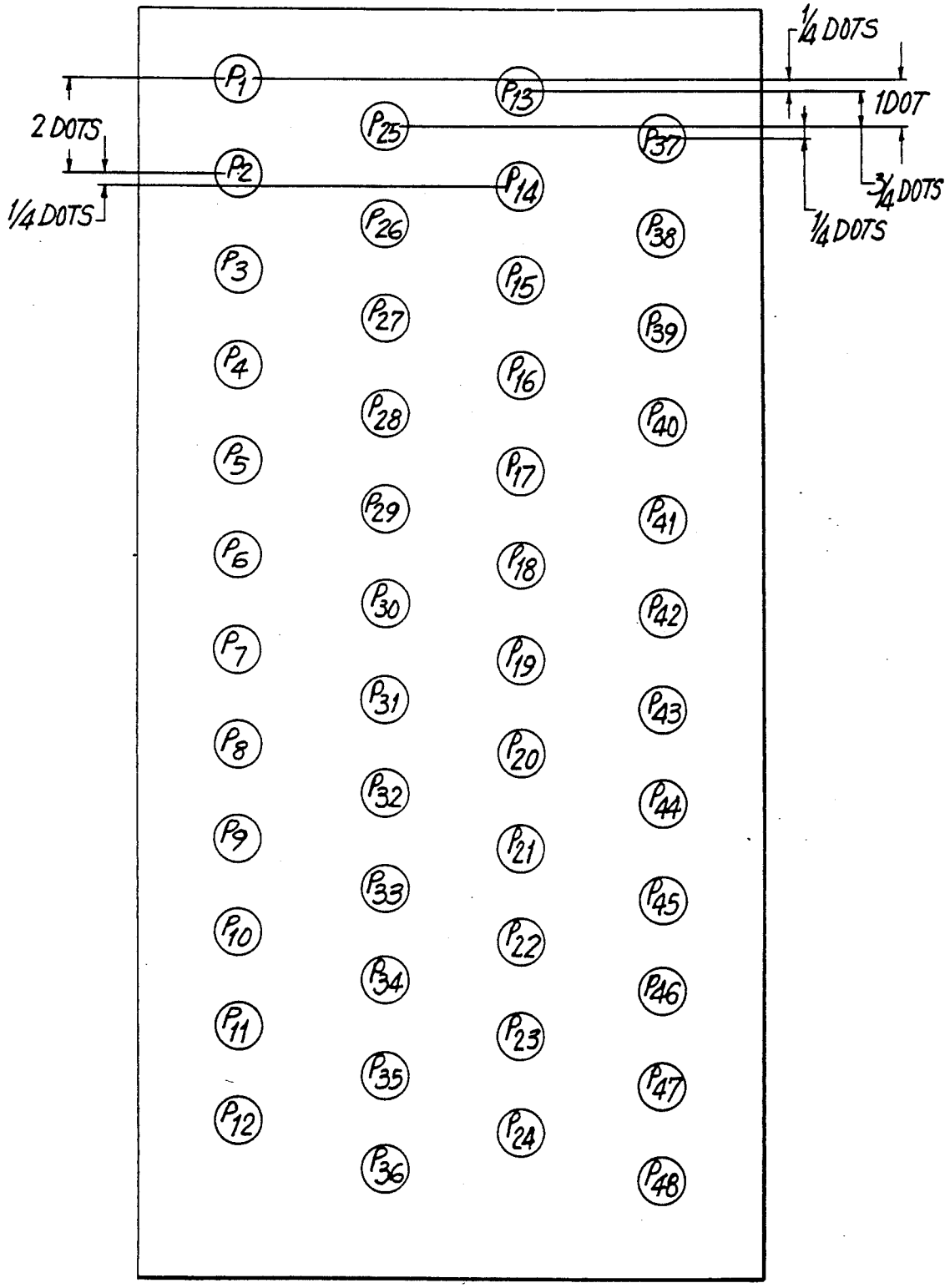
FIG. 7 is a diagram showing an alternative embodiment of the dot forming element chains of the invention.

Further, a printing head including forty eight (48) dot forming elements has been set forth above. However, the same results may be obtained with a different number of the dot forming elements. Accordingly, the system is not limited to forty eight (48) dot forming elements. The dot forming element chains can be arranged irrespective of the driving order as shown in FIG. 7. For example, the same results of the present invention may be obtained by arranging dot forming element chain P1 to P12 to be driven at the first timing of the first row, the dot forming element chain P25 to P36 to be driven at the third timing of the second row, the dot forming element chain P13 to P24 to be driven at the second timing of the third row and the fourth dot forming element chain P37 to P48 to be driven at the fourth timing of the fourth row.

In the above arrangement, the same functional effect can be obtained by shifting dot forming element chain P25 to P36 in the second row by one dot with respect to first dot forming element chain P1 to P12, by shifting dot forming element chain P13 to P24 in the third row by greater than 1/9 dot and less than ⅓ dot with respect to first dot forming element chain P1 to P12 and by shifting fourth dot forming element chain P37 to P48 by greater than 1/9 dot but less than ⅓ dot with respect to second dot forming element chain P25 to P36.

Figure 8:
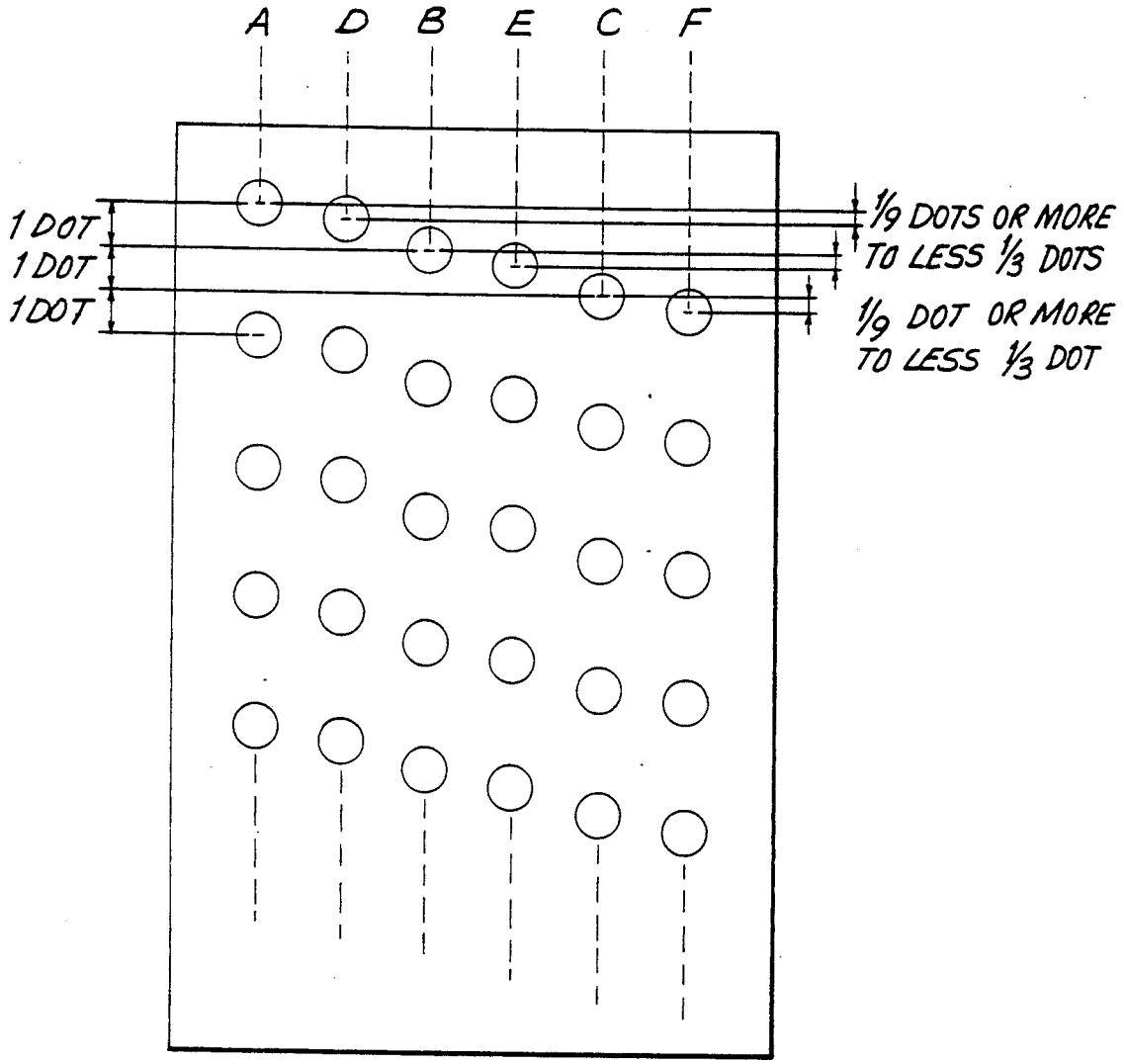
FIG. 8 is a diagram showing an arrangement of the dot forming element chains in still another embodiment of the present invention.

Further, although four rows of dot forming element chains have been set forth in the above embodiments, the same functional effect may be obtained by arranging the chain in any even numbered configuration such as six or eight rows. Referring specifically to FIG. 8, the same functional effects can be obtained with six rows of dot forming element chains as with four rows mounted on a carriage. In this configuration, six dot forming element chains (A to F) are formed by arranging a plurality of dot forming elements at three dot intervals in rows in a paper feeding direction. Dot forming element chains (A, B, C) are driven by odd numbered timings and dot forming element chains (D, E, F) are driven by even numbered timings. The rows are then shifted respectively at one dot intervals. The dot forming element chains (A, B, C) driven by odd numbered timings and the dot forming element chains (D, E, F) driven by even numbered timings are shifted respectively by an amount greater than 1/9 dot and less than ⅓ dot in a paper feeding direction.

Furthermore, the dot forming element chains have had an equal number of wires thereon in the embodiments set forth above. However, the dot forming elements of each chain may be provided with a different number. For example, the same functional effects may be obtained by arranging the dot forming element chains in a diamond or a circular shape.

Accordingly, the dot head for a serial printer as disclosed can produce high printing quality at a high printing speed in both the normal printing mode and the draft printing mode.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A serial printer having a dot type printing head for printing on a paper, including only 2N columns of dot forming elements where N is a positive integer equal to 2 or more, said printer further including a carriage supported on said printer for reciprocal movement across said paper in a carriage direction, said columns of dot forming elements being supported on said carriage for selectively printing dots on said paper, each column of said dot forming elements being spaced a predetermined distance from adjacent columns of said dot forming elements in the carriage direction, each said dot forming element column including a plurality of dot forming elements arranged in a line, drive means for selectively driving selected dot forming elements in each column of dot forming elements by one of an even numbered timing and an odd numbered timing, each column of dot forming elements driven by an even numbered timing being shifted in the column direction by one dot with respect to each other column of dot forming elements driven by an even numbered timing, each said column of dot forming elements driven by an odd numbered timing being shifted in the column direction by one dot with respect to each other column of dot forming elements driven by an odd numbered timing, each said column of dot forming elements driven by an even numbered timing corresponding to a column of dot forming elements driven by an odd numbered timing and being shifted in the column direction by less than about ⅓ dot pitch with respect to its corresponding column of dot forming elements driven by an odd numbered timing.

2. The serial printer as claimed in claim 1, wherein each said column of dot forming elements driven by an even numbered timing is shifted in the column direction by between about 1/9 and ⅓ dot pitch with respect to its corresponding column of dot forming elements driven by an odd numbered timing.

3. The serial printer as claimed in claim 1, wherein N =2 providing four columns of dot forming elements.

4. The serial printer as claimed in claim 2, wherein N =2 providing four columns of dot forming elements.

5. The serial printer as claimed in claim 1, wherein each said column of dot forming elements driven by an even numbered timing is shifted in the column direction by ¼ dot pitch with respect to its corresponding column of dot forming elements driven by an odd numbered timing.

6. The serial printer as claimed in claim 2, wherein each said column of dot forming elements driven by an even numbered timing is shifted in the column direction by ¼ dot pitch with respect to its corresponding column of dot forming elements driven by an odd numbered timing.

7. The serial printer as claimed in claim 1, wherein each said dot forming element includes a wire, said driving means including electromagnetic means for selecting driving said wires.

8. The serial printer as claimed in claim 1, wherein said dot type printing head is a wire dot print head.

9. A serial printer having a dot type printing head for printing on a paper, including only 2N chains of dot forming element where N is a positive integer equal to 2 or more, said printer further including a carriage supported on said printer for reciprocal movement across said paper in a carriage direction, said chains of dot forming elements being supported on said carriage for selectively printing dots on said paper, each chain of said dot forming elements being spaced a predetermined distance from adjacent chains of said dot forming elements in the carriage direction, each said dot forming element chain including a plurality of dot forming elements arranged in an array, drive means for selectively driving selected dot forming elements in each chain of dot forming elements by one of an even numbered timing and an odd numbered timing, each chain of dot forming elements driven by an even numbered timing being shifted in the paper feeding direction by one dot with respect to each other chain of dot forming elements driven by an even numbered timing, each chain of dot forming elements driven by an odd numbered timing being shifted in the paper feeding direction by one dot with respect to each other chain of dot forming elements driven by an odd numbered timing, each said chain of dot forming elements driven by an even numbered timing corresponding to a chain of dot forming elements driven by an odd numbered timing and being shifted in the paper feeding direction by less than about $\frac{1}{3}$ dot pitch with respect to its corresponding chain of dot forming elements driven by an odd numbered timing.

* * * * *